United States Patent [19]

Quaas

[11] 4,142,398

[45] Mar. 6, 1979

[54] QUICK-CHANGE SYSTEM FOR PROGRESSIVE DIE TOOLING

[75] Inventor: Dietmar G. Quaas, Arlington Heights, Ill.

[73] Assignee: Buhrke Industries, Inc., Arlington Heights, Ill.

[21] Appl. No.: 789,259

[22] Filed: Apr. 20, 1977

[51] Int. Cl.[2] ..... B21D 37/04

[52] U.S. Cl. ..... 72/481; 29/1 R

[58] Field of Search ..... 72/446, 448, 473, 477, 72/481; 83/563, 698; 29/1 R

[56] References Cited

U.S. PATENT DOCUMENTS

| | | | |
|---|---|---|---|
| 1,291,521 | 1/1919 | Holmes | 29/1 R |
| 2,486,075 | 10/1949 | Strom | 29/1 R |
| 3,610,021 | 10/1971 | Hopper | 83/698 X |

FOREIGN PATENT DOCUMENTS

| | | | |
|---|---|---|---|
| 3,610,021 | 10/1938 | Fed. Rep. of Germany | 29/1.5 |

*Primary Examiner*—Leon Gilden

*Attorney, Agent, or Firm*—John R. Diver

[57] ABSTRACT

A quick-change system for expediting installation of changes of progressive die tooling on single-acting presses having high slide/bed parallelism and slide-guide accuracy comprising tooling lanes having laterally-projecting tenons cooperating with lock means which mount on the press and in which the tooling is positioned by sliding and is cinched to location by heavily-leveraged means which clamp the tool onto the press using but a single manual operation.

3 Claims, 7 Drawing Figures

QUICK-CHANGE SYSTEM FOR PROGRESSIVE DIE TOOLING

BACKGROUND OF THE INVENTION

In highly-automatic progressive die systems having means for fast feeding blanks onto a receiving station, mechanisms for rapid progressive transfer of the blanks from working station to working station along the tooling lane, and means for quick-receiving the finished articles discharged therefrom, down-time for tooling repair or change can be very costly for what is generally a capital-intensive operation because generally the entire tooling system must be removed from the press. This is true whether the shutdown be because of mechanical difficulties or because a change of tooling is desired.

There is thus an established need for a quick-change system which minimizes the labor required for making changes of lane-type tooling in high-productivity tooling systems, particularly of the kind employed for can-end manufacture.

SUMMARY OF THE INVENTION

The gist of this invention lies in a quick-change system for expediting installation of progressive die tooling on single-acting presses having high slide/bed parallelism and slide-guide accuracy comprising longitudinally slidable lane paths which mount on die shoe and punch-holder adaptors on the press to slidably position the tooling and lane means which also mount on the press to cinch the tooling and clamp it in location in the lateral direction on the press. A positive stop mounts on the die shoe and punch-holder adaptors on the press (hereafter stated only as "adaptors to the press") at the end of each slidable lane path and each stop cooperates with the corresponding end of the tooling lane to longitudinally locate the tooling on the press.

In one form of the invention tapered stationary gib mounts on the press to form the back side of each slidable lane. A tapered floating gib extends along the front side of the lane in spaced and parallel relation with said stationary gib on the back side thereof forming a dovetail tooling lane on said press. A stationary back-up bar is mounted on the press in parallel relation with and against the back of the stationary gib.

Flaring tenons extend from each side of the tooling lane and engage the tapered gibs on the press making interlocking joints between the tooling lane and the press which resist pulling apart in all directions except one and provide absolute repeatability of installed lateral location of the tooling lane in the press.

A plurality of locking members, which cooperate with the stationary gibs and the floating gibs through said die shoe and said punch-holder adaptors for highly-leveraged clamping of the stationary gibs against the press and cinching the tooling lane against the same, comprise draw-bars which occupy recesses in the opposite faces of the punch-holder and die shoe adaptors and extend in the direction of the lanes thereon. A plurality of wedging seats which mount on said draw-bars cooperate with wedging heads on said locking members to produce the highly-leveraged clamping of the stationary gib and the highly-leveraged cinching of the tooling lane. Single draw-bolts thread to one end of each draw-bar and extend through bores in the walls of the recesses in the die shoe and punch-holder to protrude therefrom and engage draw-nuts for the cinching and clamping of the tooling in location on the press.

Positive stops which mount on the die shoe and punch-holder at one end of the slidable land cooperate with a corresponding end of the tooling lane installed therein to longitudinally locate the tool on the press. Belville spring push-blocks install on the die shoe and on the punch-holder at the other end of each slidable lane path and cooperate with the respective ends of the tooling lanes to hold the same longitudinally in place against said stops.

Another version of this invention comprises T-slotted slidable lane path arranged in parallel relation on both die shoe and punch-holder adaptors for lateral positioning of the tooling on the press. Square-notched gibs mount in stationary relation on the die shoe and on the punch-holder on both sides of the tooling lane paths forming the T-slots thereon. T-heads or lateral tenons on the tooling lanes slidably cooperate with said T-slotted slidable lane paths. Shot-pins cooperate with parallel alignable bores in the tooling lanes and in the die shoe and punch-holder adaptors on the press to bring the same into concentric relation one to the other for accurate lateral and longitudinal locating of said tooling on the press.

DESCRIPTION OF THE PREFERRED EMBODIMENT

Figures 1, 2:
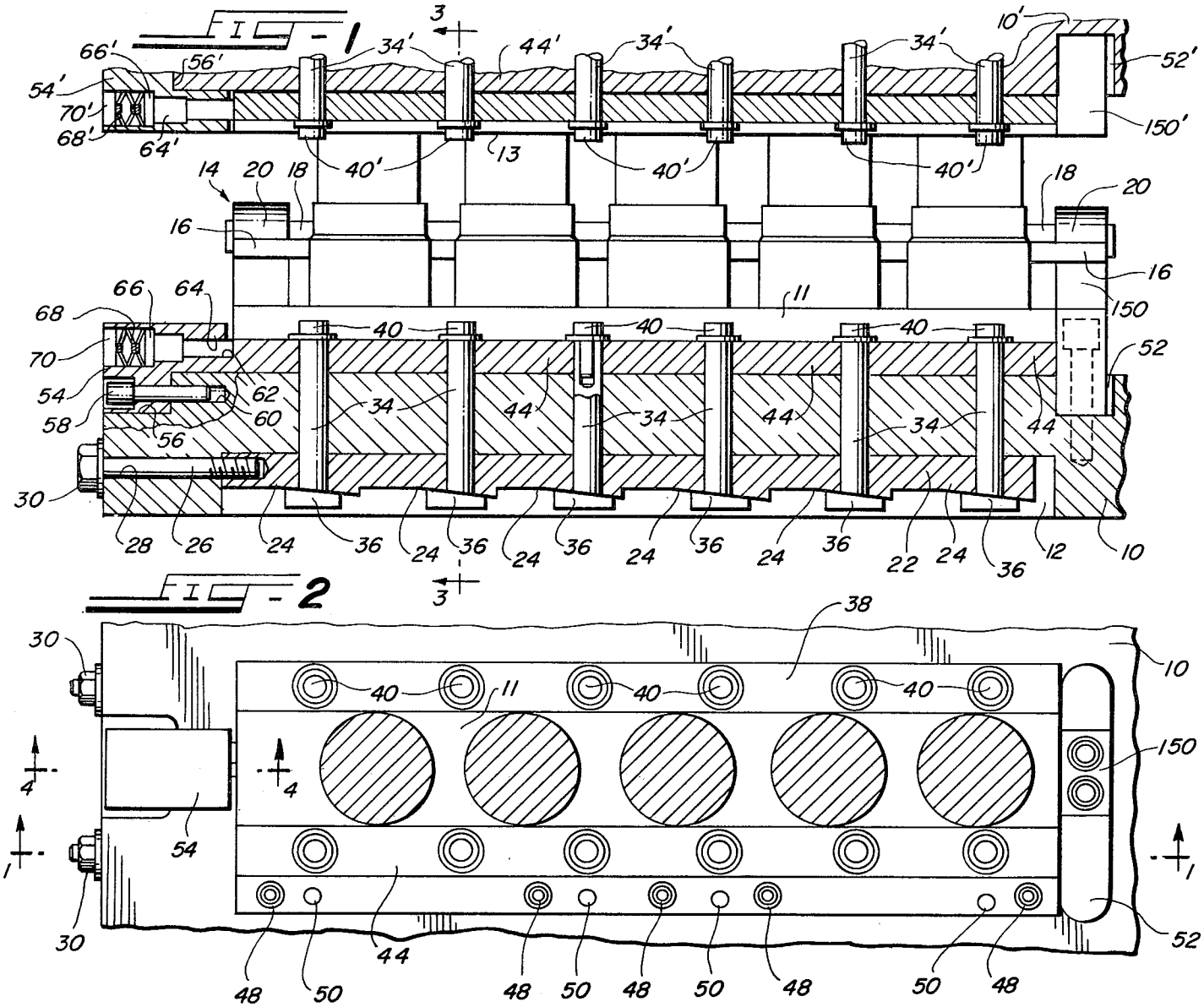
FIG. 1 shows a fragmentary cross-section elevational view of a taper-lock quick-change tooling invention taken along line 1—1 of FIG. 2.
FIG. 2 shows a fragmentary cross-section plan view of same taken along line 2—2 of FIG. 3.

Reference to FIG. 1 shows a quick-change, taper-lock, five-station tooling lane installed in a slidable lane for the conversion of can-ends in a highly-parallel slide/bed and accurate slide-guide press comprising a lower base portion 11 which mounts on a die shoe 10 which adapts to the bed of the press (not shown) and a like upper base portion 13 of the same which mounts on the punch-holder 10' and laterally and longitudinally extends above said lower portion 11 in parallel relation therewith. Recesses 12 in the bottom surface of said die shoe 10 and the top surface of said punch-holder 10' extend the length of the lower and upper base portions 11 and 13, respectively, of said tooling lane. A can-end transfer mechanism 14 including transfer bars 16 and oscillating shafts 18, as shown in FIGS. 1 and 3, pivotally mounts in bearings 20 on the top face of die shoe 10 for the tilting of the bars 16.

The lower tooling lane 11 comprises lower lock bar 22, one of which slidingly mount in each recess 12 in lower base portion 11, each having a plurality of wedging surfaces 24 on its bottom side spaced along the length of the same, each lock bar 22 engaging a threaded drawbolt 26 at one end slidingly extending through a bore 28 in said shoe 10 and threadedly engaging a nut 30 which bears against the outside surface of the left end of die shoe 10 as shown in FIGS. 1 and 2.

Figure 3:
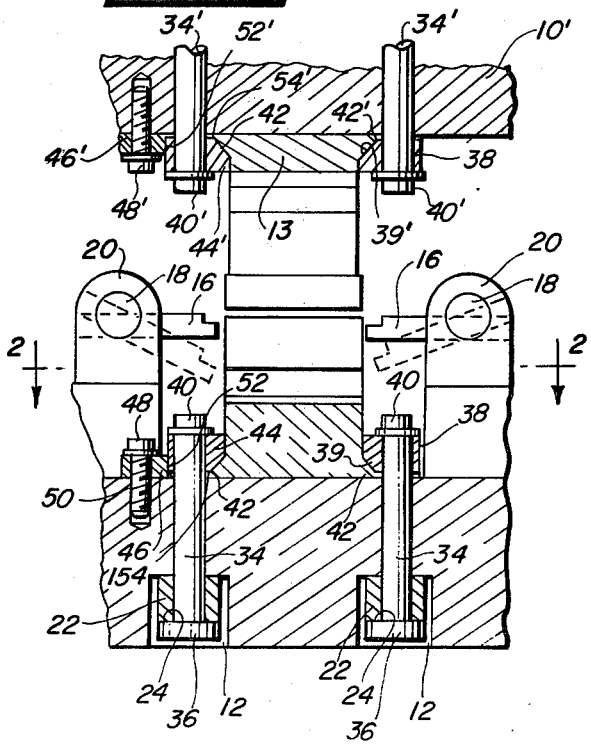
FIG. 3 shows a fragmentary cross-section end view of same taken along line 3—3 of FIG. 1.

Reference to FIGS. 2 and 3 shows a plurality of lower locking members 34 extending through the die shoe 10 having wedging heads 36 each wedgingly engaging one of said wedging surfaces 24 on the bottom side of a respective lower lock bar 22 on each side of said tooling lane 11. A lower stationary tapered gib 38, as shown in FIGS. 2 and 3, having a 45° taper along its front side, extends along the length of the tooling lane 11 and engages the back side of the same. Lower locking members 34 extend upward through said gib 38 for engagement of the top of the same by means of capscrew 40 which threadedly engages the top of said members 34 and clamps the bottom surface of gib 38 to the top surface of die shoe 10. A flaring tenon 42, as shown in FIG. 3, having a 45° taper along its back side extends the length of the tooling lane 11 in back of the same and engages the 45° taper along the front side of said gib 38.

As shown in FIGS. 1, 2 and 3, a similar plurality of lower locking members 34 in lower portion 11 have wedging heads 36 each wedgingly engaging one of the wedging surfaces 24 on the bottom side of the lower lock bar 22 in the other recess 12 which extends along the front of the tooling 11. A lower tapered floating gib 44 having a 45° taper along its back side and a flat vertical surface along its front side extends the length of the tooling 11 in front of the same, and is engages said lower locking members 34 on the front side of the said tooling. The locking members 34 extend upward through said gib 44 and engage the top thereof by means of capscrews 40 which threadedly engage the top of said members 34 to clamp the tooling 11 to the top of die shoe 10. A flaring tenon 42, as shown in FIG. 3, having a 45° taper along its front side, extends the length of the tooling 11 in front of the same and is engage by the said 45° taper along the back side of the floating gib 44 whereby the tooling 11 is forced toward and against the fixed gib 38 and then clamped to the die shoe 10.

A lower back-up bar 46, as shown in FIGS. 2 and 3, extends along the length of the bottom of tooling lane 11 in front of the same and is engaged by the heads 48 of screws 50 which extend therethrough into the top surface of shoe 10 for fixedly clamping bar 46 to the top surface of die shoe 10. A flat vertical surface 52, as shown in FIG. 3, extends the length of the back side of bar 46 and engages the flat vertical surface along the front side of lower floating gib 44 to back up said floating gib 44 as the 45° taper on its back side engages the 45° taper on the tenon 42 front side of the tooling lane 11. A working clearance 154 between the bottom surface of floating gib 44 and the top surface of shoe 10, as shown in FIG. 3, provides take-up for the clamping and locating of the tooling 11 in the press against the tapered reference surface 39 of stationary gib 38.

The upper tooling lane 13, as shown in FIG. 3, is mounted on the punch-holder 10' in the same manner as the tooling lane is mounted on the die shoe 10 and the assembly comprises lockbars in recesses in the punch-holder 10' and having wedging surfaces spaced along the length of the same as in the bars 22 and which is similarly engaged by a similar threaded draw-bolt 26' at its left end as shown in FIG. 2.

Reference to FIGS. 2 and 3 shows a plurality of upper locking members 34' in the punch-holder 10' which have wedging heads 36' for wedgingly engaging the wedging surfaces on each upper lock bar and as shown in FIG. 3 these members 34' function to clamp the upper tooling lane 13 to the punch-holder plate 10' stationary gib 38', having a 45° taper along its front side, extends along the length of the tooling and engages a 45° tapered tenon 42' extending along the back side of the same. The upper locking members 34' extend downward through said gib 38' for engagement of the bottom of the same by means of capscrews 40' which are threaded into the bottom ends of said members 34'; gib 38' may be clamped to the bottom surface of punch-holder 10'.

As shown in FIG. 3, a similar plurality of upper locking members 34' in the punch-holder 10' extend through An upper floating gib 44' which, extends the length of the tooling 13 in front of the same, has a 45° taper along its back side and a flat vertical surface along its front side. These locking members 34' engage the bottom of the gib 44' by means of capscrews 40' which threadedly engage the bottom ends of said members 34' and serve to clamp the gib 44' to the punch-holder 10'. A flaring tenon 42' on the front side of the tooling lane 13 and, having a 45° taper along its front side, extends the length of the said tooling lane and engages the 45° taper along the back side of said gib 44'. The flat front of the gib 44' engages a fixed upper back-up bar 46' which extends the length of the tooling lane upper 13 and is engaged by screws 48' which extend into the punch-holder 10' for securing the bar 46' thereto bottom surface of punch-holder shoe 10'. surface 52', on the back side of bar 46' and engages the flat vertical surface along the front side of upper floating gib 44' to back up said floating gib 44' as the 45° taper thereon drivingly engages the tenon 42' on front side of the tooling lane 13 engages the 45° under the force of the locking members 34' to position the lane 13. A working clearance 154' between the top surface of gib 44' and the bottom surface of punch-holder 10', as shown in FIG. 3, provides take-up for the clamping and location of the tooling 13 in the press against the tapered reference surface 39' of stationary gib 38'.

FIGS. 1 and 2 show a lower positive stop 150 and upper positive stop 150' which are mounted in respective recesses 52 and 52' in the top surface of the die shoe 10 and the bottom surface of the punch-holder 10' at the right hand end of the tooling lanes 11 and 13, respectively.

Figure 4:
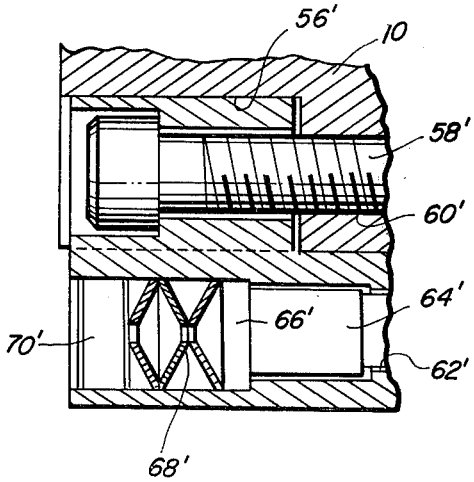
FIG. 4 shows a fragmentary cross-section side view of a typical push-block for the tooling lanes.

FIGS. 1, 2 and 4 also show a lower push block 54 and an upper push block 54' which are mounted, respectively in a third lower recess 56 in the top surface of the die shoe 10 and a third upper recess 56' and in the bottom surface of the punch-holder 10' at the left hand end of the tooling lanes 11 and 13. Lower and upper capscrews 58 and 58' engage threaded bores 60 and 60' in the left hand end of die shoe 10 and punch-holder 10', respectively, and shoulder against lower and upper push blocks 54 and 54'. Lower and upper triple-stepped bores 62 and 62', each with threaded left end extend through push blocks 54 and 54' and Lower and upper triple-stepped push pins 64 and 64' having respective heads 66 and 66' are slidingly installed in respective ones of said stepped bores said stepped bores 62 and 62'. Belville spring capsules 68 and 68' are inserted into the outer ends of the triple-stepped bores 62 and 62' and respective plugs 70 and 70' are threaded into the bores 62 and 62' to retain the said spring capsules which urge the tooling lanes against the stop blocks 150 and 150'.

Figure 6:
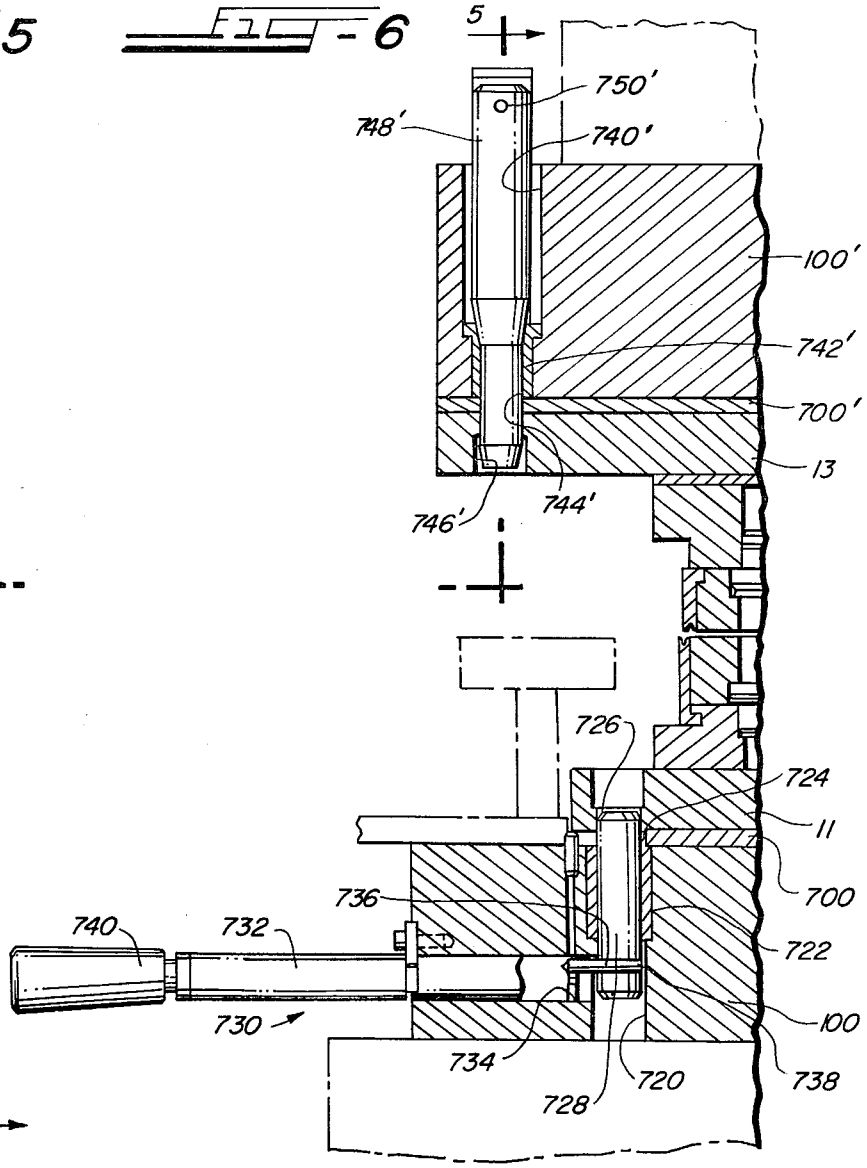
FIG. 6 shows a fragmentary cross-section side view of a shot-pin, quick-change tooling invention taken along line 6—6 of FIG. 5.
Figure 5:
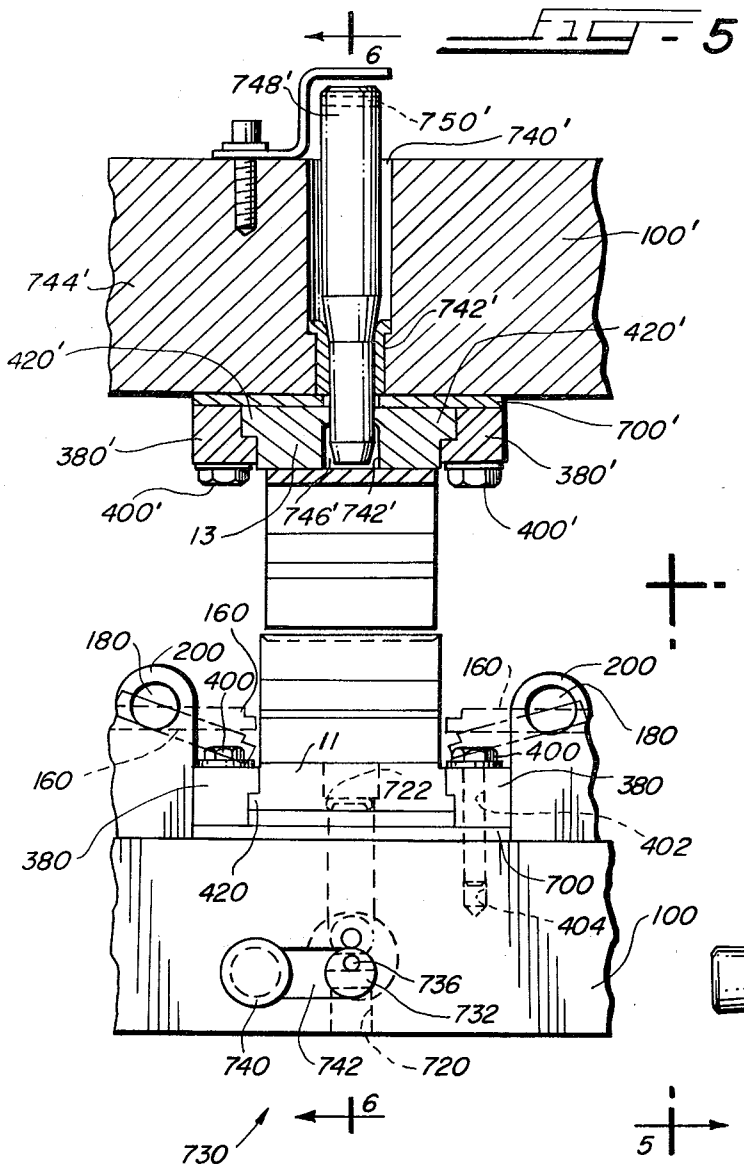
FIG. 5 shows a fragmentary cross-section end view of same taken along line 5—5 of FIG. 6.

FIGS. 5 and 6 show a shot-pin locked, quick-change progressive die tooling lane system comprising a die shoe 100 upon which the lower base portion of tooling lane 11 is mounted. The upper base portion of tooling lane 13 mounts on the under side of punch-holder 100' and extends above the tooling lane 11 in parallel relation therewith. A can-end transfer mechanism 140 including transfer bars 160 and oscillating shafts 180, as shown in FIGS. 1 and 3 is, pivotally mounted in bearings 200 on the top face of die shoe 100 for tilting the bars 160 same. Lower and upper stationary square-notched gibs 380, respectively, and 380' mount on lower and upper back-up plates 700 and 700' in spaced parallel relation and extend along the length of the tooling 11 and 13 and engage lower and upper shouldered heads 420 and 420' on the lower and upper portions of said tooling lanes 11 and 13, respectively. Lower and upper capscrews 400 and 400' engage lower and upper smooth bores 402 in gibs 380 and 380' and plates 700 and 700' and threaded bores 404 and 404' (only one of which is shown) to clamp lower and upper stationary square-notched gibs 380 and 380' to the top of die shoe 100 and the bottom of punch-holder 100', respectively.

A stepped bore 740' extends through the punch-holder 100' adjacent the left hand end of the same in a vertical plane which includes the center of the tooling lane 13, and shouldered bushing 742' bottoms in said stepped bore 740'. A clearance hole 744' extends through plate 700' in concentric relation with said bore 740'. A clearance bore 746' extends through the upper base portion of the tooling lane 13 in concentric relation with the bore of said bushing 742'. An upper shot-pin 748' push-fits its nose end through the bore of bushing 742' and into the clearance bore 746' in the upper base portion of the tooling lane 13 of the shot-pin 748' provides for purchase in withdrawal of the nose-end of pin 748' from the bore 742' in the upper base portion of the tooling lane 13.

A stepped bore 720 extends through the die shoe 100 adjacent the left hand end of the same in a vertical plane which includes the center of the tooling lane 11. A bushing 722 inserts in said bore 720. A clearance hole 724 extends through plate 700 in concentric relation with said bore 720 and a bore 726 extends through the lower base portion of the tooling lane 11 in concentric relation with the bore of bushing 722. A lower shot-pin 728 push-fits its nose end through the bore of bushing 722 into the bore 726 in the lower base portion of the tooling lane 11.

A crank mechanism 730 comprises a shaft 732 which extends from a bore 734 in the left hand end of and in the vertical plane which includes the center of the tooling lane 11. Bore 734 intersects bore 720 at right angles and a crankpin 736 extending from the right hand end of the shaft 732 in eccentric relation to the center of said shaft 732 engages a circumferential slot in the shank end of the lower shotpin 728. An eccentric crank-handle 740 mounts on crank-throw 742 on the left hand end of the shaft 732 for manually inserting and withdrawing the nose-end of said pin 728 from the bore 726 in the base portion of the tooling lane 11.

Figure 7:
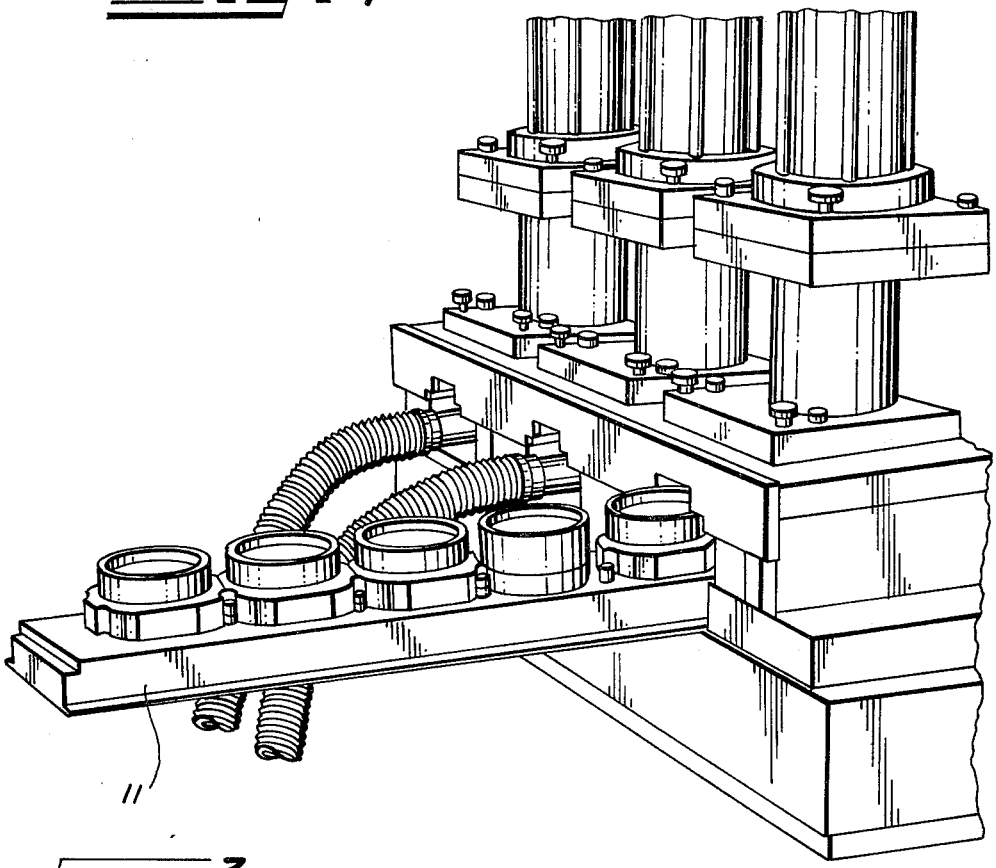
FIG. 7 shows a perspective of the manner of use of the invention in the quick-change of tooling.

Reference to FIG. 7 shows the method of use of this invention.

It will be understood that details of the constructions shown may be altered or omitted without departing from the spirit of the invention as defined by the following claims.

I claim:

1. A system for expediting installation of tooling lanes on presses having high slide/bed parallelism and slide-guide accuracy and a die shoe mounted on the bed and a punch-holder adaptor mounted on the ram of said press, each die shoe and punch-holder adaptor supporting said system, comprising:

(a) first and second tenon means formed on opposite sides of said tooling lane;

(b) a back-up means longitudinally mounted in stationary relation on said die shoe and punch-holder adaptor adjacent to and spaced from said first tenon means;

(c) a first gib means longitudinally mounted against lateral movement on said press between and in engagement with said first tenon means and said back-up means;

(d) a second gib means slidably cooperating with the second tenon means in lateral floating relation with said back-up means and in spaced and parallel relation with said first gib means to form a slidable tooling lane path between them;

(e) a plurality of locking members having longitudinally-inclined wedging heads at one end thereon extending through said die shoe and punch-holder adaptor and connecting with the gib means;

(f) a draw-bar longitudinally-slidable on said die shoe and punch-holder adaptor having a draw-bolt extending longitudinally therefrom and longitudinally-inclined wedging seats thereon for engaging said wedging heads on said locking members in the direction for cinching the first tenon means up against the first gib means and clamping said tooling lane against said press; and (g) positive stop means mounted on said press at the end of the slidable tooling lane and cooperating with the end of the tooling lane for longitudinal locating of said tooling on said press.

2. In a system as set forth in claim 1, wherein the clamping means comprises a plurality of locking members having longitudinally-inclined wedging heads at one end and extending through the die shoe and punch-holder adapter and connecting with the gib means at its other end, and a draw-bar longitudinally mounted in slidable relation on said die shoe and punch-holder adaptor having longitudinally-inclined wedging seats engaging said wedging heads on said locking members, and draw means extending longitudinally therefrom for longitudinally pulling the draw-bar wedging seats against the heads of the locking members; whereby a reaction to the longitudinal pulling of the draw-bar wedging seats against the wedging heads of the locking members is provided wholly within the die shoe and punch-holder adaptor.

3. A system for expediting installation of tooling on a press having high slide-bed parallelism and slide-guide accuracy, said press having a die shoe mounted on the press bed and a punch-holder adapter mounted on the ram of the press, said tooling having an orthogonal base and said die shoe and the punch-holder adapter each having an orthogonal clinching means mounted thereon for slidably cooperating with the orthogonal base of the respective tooling for guiding longitudinal movement thereof, said tooling having first and second tenon means formed on opposite sides of the tooling base, and said clinching means comprising:

(a) respective first gib means longitudinally mounted on the die shoe and on the punch-holder adapter for parallel engagement with the first tenon means of the respective tooling and secured against lateral movement relative thereto;

(b) respective second gib means mounted on said die shoe and the punch-holder adaptor in spaced parallel relation with the first gib means for slidable cooperating relation with the second tenon means on the tooling;

(c) said die shoe and punch-holder adaptor each having a plurality of locking members extending therethrough with one end connecting with the respective gib means, each locking member having a longitudinally inclined wedging head at its opposite end;

(d) drawbar means mounted in longitudinally slidable relation on said die shoe and on said punch-holder adaptor and having longitudinally-inclined wedging seats engaging the wedging heads of said locking members; and (e) means for pulling said drawbar means longitudinally to draw said wedging seats against the wedging heads of the locking members for clinching said gib means against the tooling tenon means.

* * * * *